US005499464A

United States Patent [19]

Geiger

[11] Patent Number: 5,499,464

[45] Date of Patent: Mar. 19, 1996

[54] COMPENSATION FOR FRICTION FORCE IN A LAUNDRY MANGLE

[75] Inventor: Friedrich Geiger, Todtenweis, Germany

[73] Assignee: Bowe-Passat Reinigungs Und, Augsburg, Germany

[21] Appl. No.: 211,053

[22] PCT Filed: Aug. 24, 1992

[86] PCT No.: PCT/EP92/01937

§ 371 Date: Jul. 25, 1994

§ 102(e) Date: Jul. 25, 1994

[87] PCT Pub. No.: WO93/06292

PCT Pub. Date: Apr. 1, 1993

[30] Foreign Application Priority Data

Sep. 27, 1991 [DE] Germany ..... 41 32 213.4

[51] Int. Cl.[6] ..... D06F 63/00

[52] U.S. Cl. ..... 38/46; 38/60

[58] Field of Search ..... 38/44, 45, 46, 38/47, 48, 52, 58, 59, 60, 61, 10, 16, 18; 100/93 B, 93 RP, 163 A, 164, 166, 169

[56] References Cited

U.S. PATENT DOCUMENTS 2,657,483 11/1953 Zwaard ..... 38/58

FOREIGN PATENT DOCUMENTS

| | | | |
|---|---|---|---|
| 0622646 | 4/1935 | Germany . | |
| 0024331 | 12/1959 | Germany . | |
| 1211122 | 10/1963 | Germany . | |
| 1813594 | 12/1968 | Germany . | |
| 3401802 | 7/1985 | Germany | 38/44 |
| 3627632 | 8/1986 | Germany . | |
| 3618423 | 8/1987 | Germany | 38/44 |
| 9004179 | 4/1990 | Germany . | |
| 0351381 | 10/1972 | U.S.S.R. | 38/46 |
| 2088416 | 6/1982 | United Kingdom | 38/18 |

*Primary Examiner*—C. D. Crowder
*Assistant Examiner*—Ismael Izaguirre
*Attorney, Agent, or Firm*—Wigman, Cohen, Leitner & Myers

[57] ABSTRACT

A laundry mangle has at least one mangling roller held in a working position inside a heatable trough by at least one carrying arm. The mangle roller and the trough are held in relative moveable positions by at least one adjusting member, delimiting together the inlet and outlet sides of a passage for laundry pieces. The adjusting member allows a force to be exerted on the mangling roller and/or trough that counteracts the frictional force generated during operation of the mangle, so that a constant or increasing ironing pressure towards the outlet side is set. The frictional force (R) generated during mangling is thus compensated, so that a gentle, wear-free mangling process is achieved. In addition, the mangling capacity is increased, compared with known mangles.

8 Claims, 4 Drawing Sheets

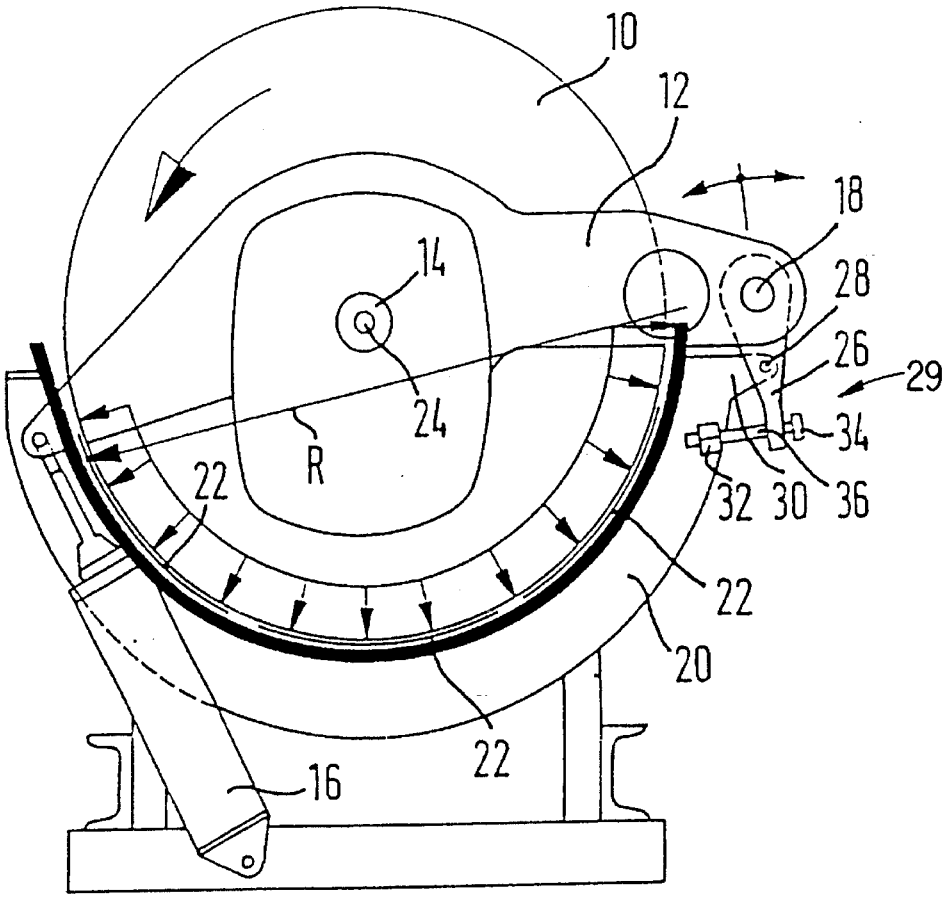
FIG. 1
FIG. 2
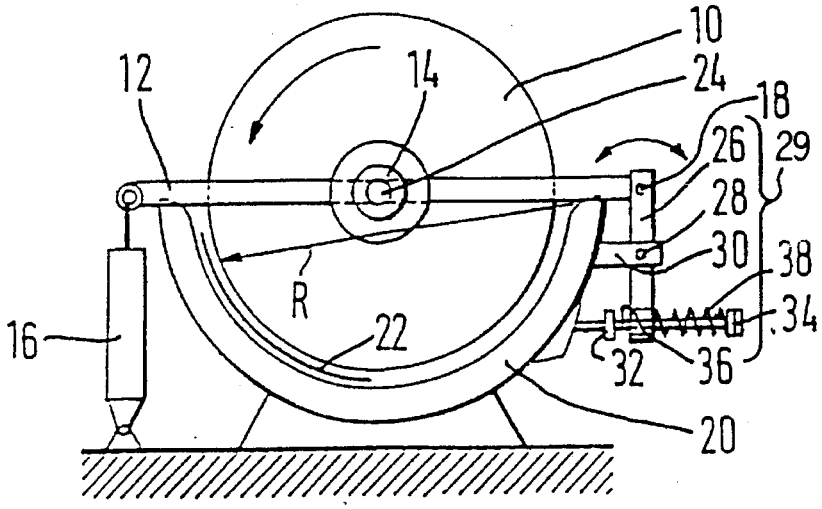
FIG. 3
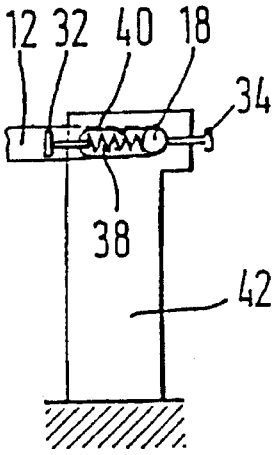

COMPENSATION FOR FRICTION FORCE IN A LAUNDRY MANGLE

BACKGROUND OF THE INVENTION

The invention relates to a laundry mangle comprising at least one mangle roller, which is held by means of at least one supporting arm in a heatable trough, in a service position, in which the mangle roller and the trough assume by means of at least one adjusting means a moveable position relative to each other that defines an inlet and outlet side for the passage of laundry articles.

A laundry mangle is known from the PCT/WO 85/03313, where there are several mangle rollers arranged successively in series. Due to the adjustability of the respective mangle roller to the assigned trough, an approximately parallel, preferably coaxial positioning of the longitudinal axes of the roller and semi-rotary cylinder can be obtained, a feature that should guarantee a frictionless operation of the mangle. Furthermore, it is possible to swing the mangle roller completely into or out of the trough, in order to have unimpeded access to the trough, for example, for the purpose of removing the laundry articles that have become caught, cleaning and/or ventilation.

To this end, the ends of the bearing axle of the respective mangle roller can be rotated in a pair of supporting arms, which can be swung up and down by means of a working cylinder around a stationary bearing point. The bearing, which can be adjusted within a narrow range, in the form of a bearing point, in order to guarantee frictionless operation, is then set in such a manner that a coaxial service position between mangle roller and assigned trough is achieved as far as possible; a position that is then fixed in tire effective service position.

The friction generated in this service position that is set once, between the mangle roller and the surface of the trough and that should have as low a value as possible does not remain, however, uniform and constant during service. First, due to its torque the driven mangle roller has the tendency to move in the direction of the trough on the inlet side of the mangle, a state that reduces on the inlet side the distance between mangle roller and trough, thus resulting in raised frictional values at this point. Secondly, the friction on the trough surface changes in an irregular and unpredictable manner, for example due to nonuniform heating or during the introduction of laundry articles, which, of course, exhibit different sizes, thickness and also frictional values and, being dragged along by the roller surface so as to cause friction, are moved along the trough surface.

This frictional force thus generated leads especially in the inlet sided region of the mangle to a nonuniform and raised ironing pressure. At the same time the mangle performance drops, since the ironing pressure on the laundry outlet side of the mangle drops due to the corresponding increase in distance from the trough, thus not resulting in the thermal transfer required there, whereas in the inlet sided region said ironing pressure increases only insignificantly as the pressure increases. The high pressure on the inlet side results in an undesired high wear not only on the laundry articles but also on the roller lining applied on the surface of the mangle roller.

A mangle of the aforementioned class is known from the DD-PS 24 331, where the mangle roller and the trough assume by means of the adjusting means a moveable position relative to each other while the mangle is operating. On both sides the mangle roller is mounted on a supporting arm, by means of which it can be swung out; and simultaneously a drive wheel for the mangle roller is mounted on the swivel pin. Mangle roller and drive wheel are connected together by means of the meshing of a gear wheel. To eliminate the resulting tooth pressure, which leads to a nonuniform ironing or pressing pressure within the trough, the known rotary mangle provides that between the gearwheel of the roller axle that exhibits the same or approximately the same diameter, and the actual drive wheel on the supporting arm there is an intermediate wheel, which can also be swung out. Furthermore, a spring energy store engaging at the support arm is provided as the adjusting means. The addressed deleterious tooth pressure is, in fact, eliminated with this known mangle. Yet at the same time forces are generated that push the mangle roller on the inlet side against the trough and move away from said trough on the outlet side. The result is an increase in the frictional force and thus a nonuniform ironing pressure that is excessive on the inlet side with the aforementioned drawbacks.

In another mangle of this class according to the DE-OS I 813 594 the mangle roller is suspended rotatably from a supporting arm, which forms a rocking arm and which is attached in such a manner to a mangle housing that it slopes upward from the roller axle to the housing suspension, thus resulting in an angle ranging from 0° to 90° between the rocking arm and a horizontal line extended through the center point of the roller, when seen in the direction of rotation. The larger the angle is chosen, the greater is also the contact force of the roller on the trough, and the greater is the frictional force between the mangle roller and the trough. Not to exceed at this stage a deleterious maximum frictional value as the strength of the laundry articles increases, the trough can be swivelled flexibly by means of adjusting means as a spring energy store. With this known laundry mangle the resulting frictional force can be compensated for only partially and in particular the ironing pressure cannot be set either constantly or increasingly in the direction of the outlet side.

In another kind of known laundry mangle of this class according to the DE-AS 1 211 122 the mangle roller is pivot-mounted on supporting arms by means of one pair and enveloped in the swung-in state stationarily by an ironing trough, which is designed as a half shell and whose fee ends are driven by means of a mechanical device or with a heating medium in such a manner that they move toward each other during service in order to increase the ironing pressure, thus reducing on the inlet and outlet side the distance between mangle roller and trough. In addition, to decrease the pressing pressure the mangle roller can be simultaneously lifted by means of the two supporting arms, With this known mangle roller the ironing pressure for the laundry articles can be increased on the inlet and outlet side, so that at these points altogether high frictional values with the drawbacks described above are generated. In contrast, the frictional values drop in the center of the trough and the ironing pressure decreases dramatically, so that altogether the mangle output of this known mangle is low.

Starting from this prior art, the invention is based on the problem of providing a laundry mangle, where the described drawbacks are avoided. This problem is solved by a laundry mangle exhibiting the combined features of claim 1.

Since, according to the invention, a force, which counteracts in such a manner the frictional force generated during service of the laundry mangle that the ironing pressure is constant or increases in the direction of the outlet side, is exerted by means of the respective adjusting means on the mangle roller and/or the trough, which assumes during service a moveable position relative to each other, a dynamic adaptation of the position of the mangle roller and the trough to each other during service of the laundry mangle is achieved, during which service the force compensating for the frictional force increases or decreases, depending on whether the frictional force acting between the mangle roller and the trough increases or decreases. In so doing, first the distance between the mangle roller and the trough increases in principle on the inlet side and then decreases on the outlet side during service of the mangle.

Thus, an undesired increase in the ironing pressure in the feed sided region of the mangle is reliably avoided. Rather the compressive load per unit area remains constant or increases in the direction of the outlet side along the entire ironing gap, formed between mangle roller and trough. This allows a careful pressing of the laundry and the wear is low, especially at the roller lining. Size and direction of the frictional force and thus the compensating force result from the contact pressure and direction of rotation of the roller. Within the scope of the invention it is basically irrelevant whether the roller is braced moveably with respect to the roller, attached stationarily with its bearing axle, against the compensating force of the force-generating device, according to the application for protection.

Provided the respective adjusting means act in such a manner that the ironing or pressing pressure increases constantly in the direction of the outlet side, increased mangling output can be obtained. Owing to the relatively high temperature difference between the laundry articles, introduced on the feed side, and the heating temperature in the ironing gap there, no improved drying results can be obtained any more even with relatively high ironing pressures. However, this state improves if the temperature differential decreases following passage through the respective trough. If then a correspondingly high ironing pressure is generated on the outlet side, the result on average is significantly improved thermal transmission coefficients. If viewed from the point of view of total energy, in the laundry mangle designed to this end, the mangle output compared to a laundry mangle with constant ironing pressure is definitely raised over the entire trough surface, without resulting, however, in a wear of the laundry articles and/or the mangle. For the following troughs the mangle output, can be optimized to the effect that for a roller, which follows immediately in the conveying direction and exhibiting a trough, a uniform ironing pressure is set by means of the adjusting means; and for the roller that follows last and exhibits a trough the ironing pressure is set so as to decrease in the direction of the output side. The mangle roller arranged last when seen in the conveying direction discharges the already dried laundry articles, without any unnecessary overheating, damaging the laundry articles, on the outlet side. These embodiments make it clear that with suitable adjustment of the setting means for the laundry mangle according to the invention, the conventional design of a laundry mangle can also be realized, provided it seems expedient with regard to energy considerations. Thus, with the laundry mangle according to the invention, a wide band range of possible operating modes for a mangling process of laundry articles can be realized, without necessitating any significant structural modifications.

In an especially preferred embodiment of the laundry mangle according to the invention, two working cylinders are provided, of which one absorbs the gear-sided driving torque. On the basis of this arrangement a uniform ironing pressure within the trough can be generated with two identical working cylinders when the lever arm is shortened on the socalled exhaust air side of the laundry mangle, a feature that can lower the production costs of the laundry mangle according to the invention.

Other preferred embodiments of the invention are the subject matter of the dependent claims.

The invention is explained in detail with reference to the drawings.

FIG. 1 is a side view of the drive side of a laundry mangle with a compensation for the frictional force by means of an obliquely engaging working cylinder and with moveable roller bearing.

FIGS. 2 and 3 are side view of a laundry mangle with flexibly braced roller bearing or a modified embodiment of the roller bearing.

Figure 5:
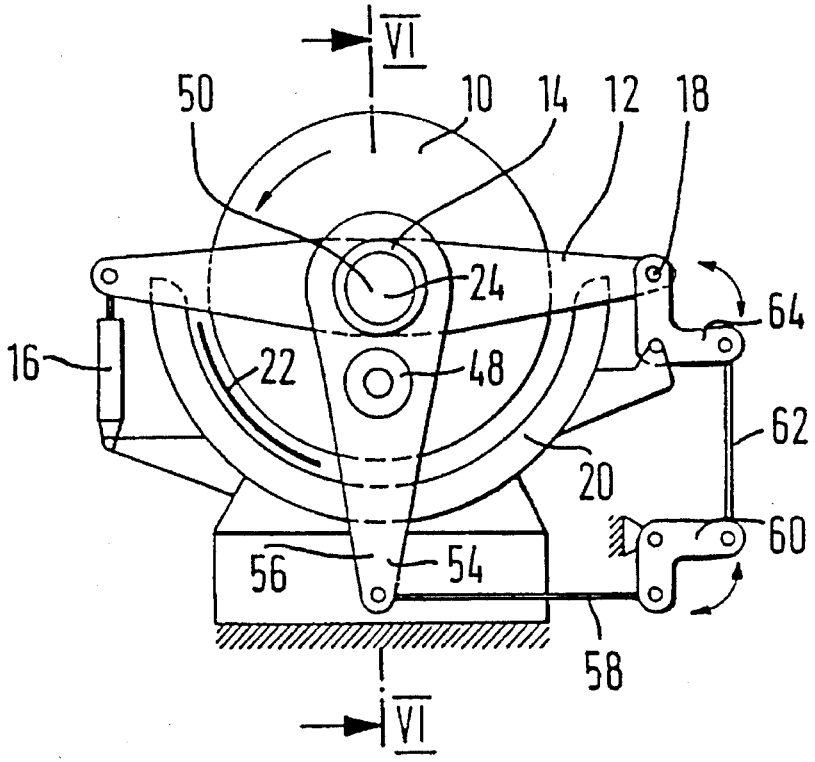
FIG. 5 is a side view of a laundry mangle with compensation for the frictional force caused by the roller drive forces.
Figure 7:
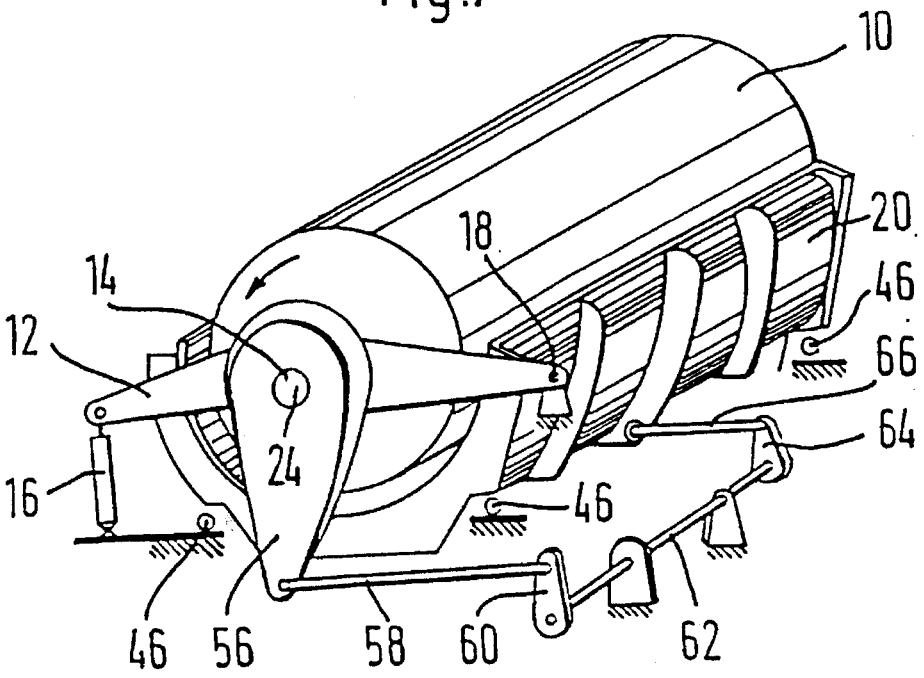
Figure 8:
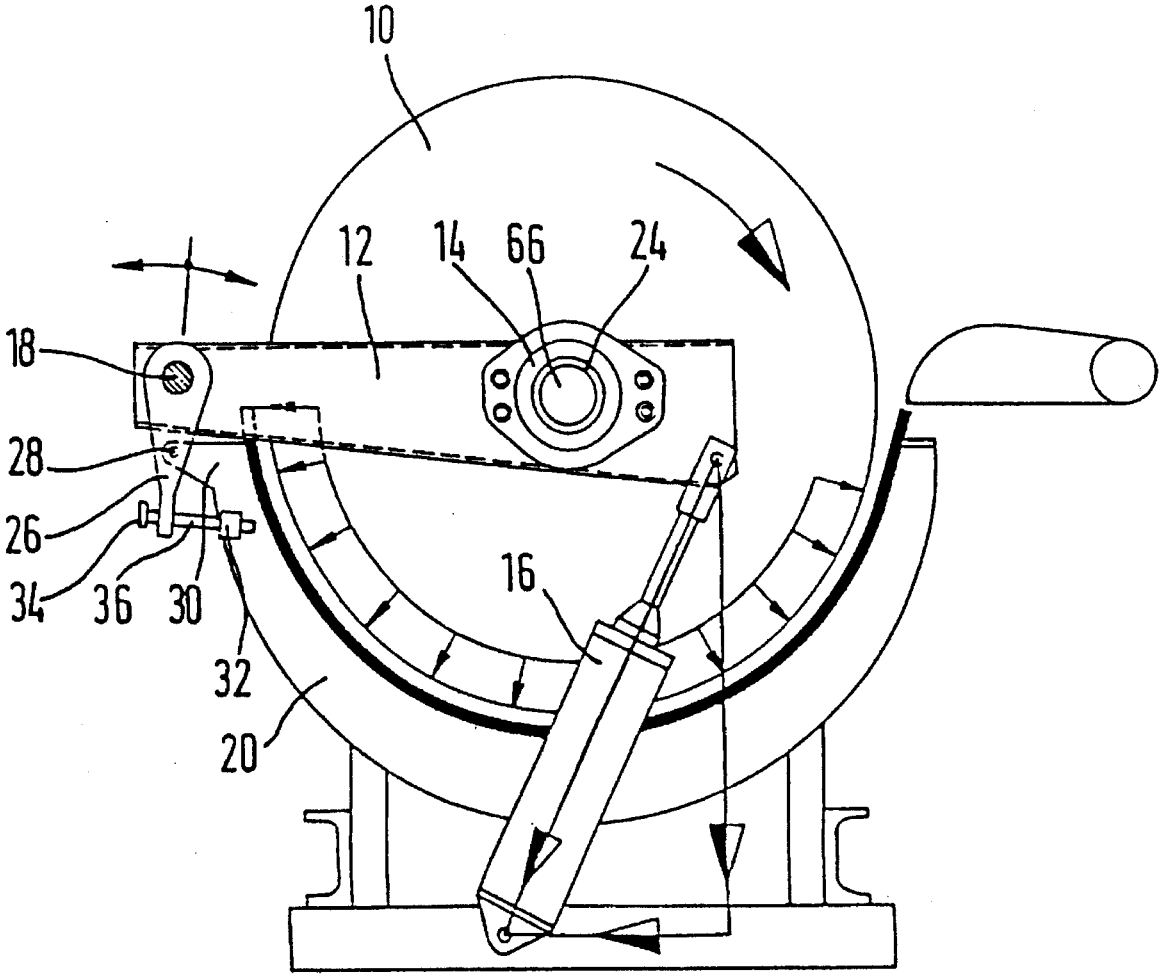

FIG. 7 depicts an embodiment of the laundry mangle that corresponds to FIG. 5 and exhibits a stationary mangle roller and an adjustable trough; and FIG. 8 is a side view corresponding to FIG. 1 from the exhaust side of a laundry mangle, In the mangle according to FIG. 1, the mangle roller 10 is pivot-mounted in bearings 14 at a pair of lever arms 12 and is driven by means of a drive (not illustrated in detail) counterclockwise according to the direction of the arrow, as seen in FIG. 1. A working cylinder 16, by means of which the roller 10 can be swung around a swivel pin 18 in the known manner both up and down out of or into the stationary, heatable ironing trough 20, engages at the pair of lever arms 12, of which only the front arm is visible in the drawing. The swivel pin 18 is formed, for example, by means of a torsion shaft, which connects together the two arms of the pair of lever arms 12 as a part of the lever linking. The laundry articles 22 travel through the mangle from the input side to the output side, thus from left to right in the direction of the arrow as seen in FIG. 1.

The bearing axle 24, whose ends are held in the two bearings 14, has in essence a horizontal orientation and extends transversely to the longitudinal directions of both arms of the pair of lever arms 12. The bearing axle 24 coincides in essence with the longitudinal axis of the heatable trough 20, thus assigned to said trough coaxially. The imaginary longitudinal axis of the trough 20 is obtained in this case, if the ends of trough 20 that are free at the top are connected together by means of a imaginary plane and draw a line in approximately the center of said plane between the two free ends.

The swivel pin 18 whose ends form a bearing point for the respective lever arm is mounted with its two end sided pins in a pair of levers 26, which forms another part of the lever linkage and whose levers can be swivelled around a pivot pin 28 and are connected to the ironing trough 20 by means of one part of the linkage 30. The position of this pair of levers 26 can be attached with a specified play by means of two final control elements 32 and 34 that define the range of swivel. To this end, in the illustrated embodiment a threaded rod 36, hinged to the trough 20, is guided through an eye at the free end of one arm of the pair of levers 26, on which are arranged, in the figure when viewed from right to left of this lever, the final control elements 32 or 34 designed here, for example, as a screwhead or as a setscrew. Preferably a setter for both levers of the pair of levers 26 is provided. Thus, the pair of levers 26 can be moved freely with play along the threaded rod 36 and restricted in movement, in particular by means of the final control element 34. The possible swivel range of the pair of levers 26 is shown by the double arrows in FIG. 1.

If the sum of all frictional forces generated in the system—rollers 10, trough 20 and optionally the laundry articles 22—is formed, the result is a summation vector, whose size and direction is reproduced approximately in FIG. 1 by means of a force vector, denoted as "R". This frictional force R results in an increase in the compressive load per unit area on the inlet side of the laundry mangle and a restriction in the gap between the roller 10 and trough 20 at this spot. Furthermore, the gap between the roller 10 and the trough 20 enlarges on the outlet, side of the laundry mangle. If the force vector R is dissected into its components, the result is not only a vertical force component acting downwardly as seen in FIG. 1 but also a horizontal vector, whose direction acts in the direction of the inlet side, to the left when viewed in FIG. 1.

To generate a counteracting counter or retaining force, the working cylinder 16 engaging first with the pair of lever arms 12 is sloped in such a manner that, in addition to a vertically oriented force component, it can also exert, a horizontal force component on the bearing axle 24, which counteracts the horizontal force component of the frictional force R and whose size corresponds in essence to it, so that the mangle roller 10 is pushed away from the trough surface on the inlet side counter to the direction of the frictional force R, in order to reduce the normal tension acting there. In addition, the already addressed final control elements 32 and 34, which limit the maximum possible swiveling range of the pair of lever arms 12 when counter force is generated, serve as a kind of steadying surface for the case that the mangle roller 10 should be totally lifted out of the ironing trough by means of the working cylinder 16. The force-generating device, here in the form of the working cylinder 16, which can be a fluid or pneumatic cylinder, can be selected in order to stipulate the force to be generated by it, by means of a hydraulic or pneumatic control (neither of which illustrated), which form the setting means.

The size of the frictional force R can be calculated or measured. Moreover, its size and direction is largely known for mangle service with the aid of empirical values. With the aid of the values obtained thus for the frictional force R, the setting angle of the working cylinder 16 and thus the force to be generated by it can be derived. To obtain the constant ironing or pressing pressure, which is shown in FIG. 1 and which is indicated with a semi-circular vector picture, or to obtain an ironing or pressing pressure (not illustrated) that increases constantly in the direction of the outlet side, a fixed, enlarged distance or decreased distance can be set on the inlet side or on the outlet side between the ironing trough 20 and the mangle roller 10. Since, however, the mangle roller 10 is not fixed in position with its swivel pin 18, but rather can pivot by means of the pair of levers 26 with a specifiable play in the direction of the double arrows, a dynamic force equilibrium is given during service of the laundry mangle, whereby the mangle roller 10 moves automatically in such a manner relative to the trough 20 as a function of the generated frictional values that the frictional values are compensated for. In another embodiment of the invention it can also be provided that the working cylinder 16 acts like a damping element, which cushions elastically the stresses that occur and also contributes to the minimization of the frictional values.

The following embodiments are only explained insofar as they differ from the embodiment described above. At the same the same reference numerals are used for the components exhibiting the same functions as for the first embodiment.

In the embodiment according to FIG. 2, the working cylinder 16 is hinged with its direction of force extending vertically to the pair of lever arms 12, Moreover, the adjusting means or the force-generating device are formed by means of a spring store in the form of a compression spring 38, which can be moved on the rod 36 and which tries to push the bottom end of the assigned lever of the pair of levers 26, seen to the left in FIG. 1, thus the roller 10, which rotates counterclockwise in the trough 20 during service and rubs therein, to the right against the acting frictional force R. The size of the spring pressure is set during startup by actuating the final control element 34 in accordance with the average frictional force, which is to be expected and which can be calculated, measured or also obtained from empirical experience. The possible swiveling range of the pair of levers 26 is shown in turn by means of the double arrows in FIG. 2. Furthermore, the final control element 32 serves to reliably define the range of motion of the pair of levers 26 and could also be omitted. Due to the floating bearing of the swivel pin 18, a dynamic adaptation to changing frictional values is given by means of the adjusting means, here in the form of a compression spring 38.

In the embodiment according to FIG. 3, the bearing of the swivel pin 18, thus the respective bearing point, is provided in an oblong hole 40 of a statationary frame 42, instead of at a pair of levers 26, as shown in FIGS. 1 and 2. The swivel pin 18 can be set by means of setting means, which are also formed by the final control elements 32 and 34, whereby here the compression spring 38 tries to push the bearing of the swivel pin 18 or the respective pin of the torsion shaft, seen in FIG. 2 from left to right, against the stop of the final control element 34. Preferably here, too, the springy bearing is provided on both sides or both ends of the swivel pin 18 of the pair of levers 12.

Figure 4:
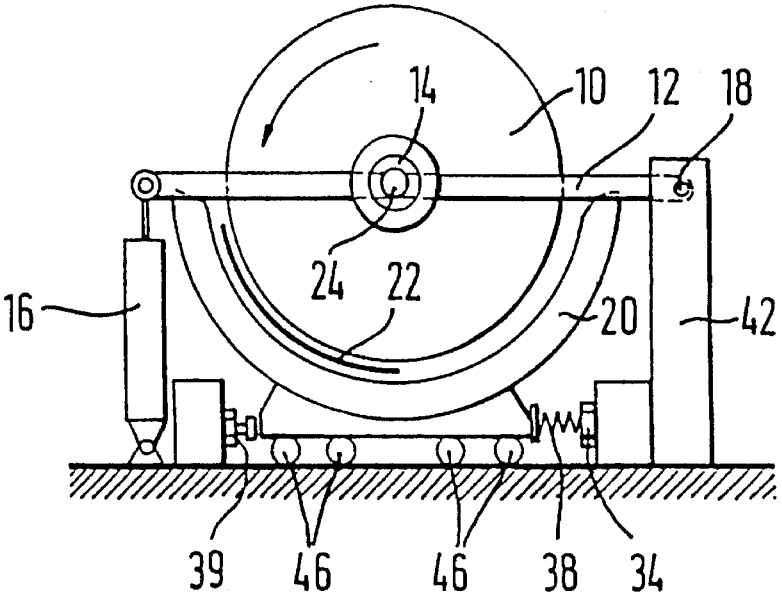
FIG. 4 is a side view of a laundry mangle with trough, which is flexibly braced and can be set relative to the stationary mangle roller.

In the arrangement according to FIG. 4, the trough 20 can be moved on rollers 46 while the bearing axle 24 is mounted stationarily. The force of a compression spring 38 can be set by means of a final control element in the form of a setscrew 34. Said spring 38 pushing against the trough 20 in the horizontal direction acts here in the same manner as in the case of the setter according to FIGS. 2 and 3. Thanks to the force of the compression spring 38 the trough 20 is moved to the left, as seen in FIG. 4, so that the ironing pressure rises on the outlet side and falls on the inlet side, until a substantially constant compressive load per unit area prevails along the entire ironing gap. To limit the free distance traversed by the trough 20, a limiting element 39 is provided in the form of a setscrew, which occupies a specified distance to the trough 20, so that there is little play between setscrew 39 and trough 20.

Figure 6:
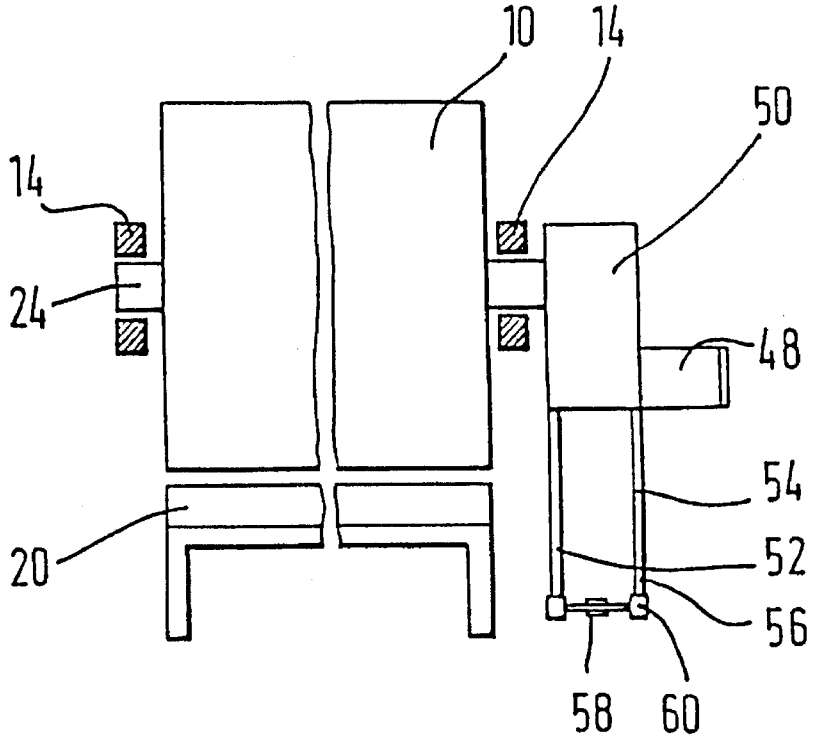
FIG. 6 is a sectional view according to line VI—VI of FIG. 5.

FIGS. 5 and 6 show an embodiment, in which the driving torque, which is exerted on the roller 10 and also causes the roller friction, is virtually compensated for. At the same time the driving torque itself serves to compensate for the frictional force produced between roller 10 and trough 20. The mangle roller 10 mounted in turn on a pair of lever arms 12 is driven by means of a drive unit, sitting on the bearing axle or on the shaft 24 of the mangle roller 10 and comprising a motor 48 and a gear 50. From this drive unit 48, 50 extends, seen from the bottom in FIG. 5, a second lever arm 56 formed by two legs 52, 54.

A rod 58 is hinged to this lever arm 56; said rod transfers a force, exerted by the lever arm 56, to a first angle lever 60, which is hinged stationarily and which diverts upwardly the force by approximately 90°, seen in FIG. 5, and delivers to another rod 62. Said rod actuates another second angle lever 64, which is hinged to the stationary trough 20 and which transfers the force, which is transferred by the rod 62 and diverted by another 90°, to the lever arm 12. At the same time the angle lever 64 approximates with regard to its function the pair of levers 26 of the embodiments according to FIGS. 1 and 2, except that here the compensating force is formed directly by means of the driving torque of the roller 10, which is transferred to the bearing axle 24 by means of the lever linkages 56, 58, 60, 62, 64, 12.

The result of the idle bearing of the motor 48 and the gear 50 in the second lever arm 56 is, in addition to the driving torque of the mangle roller 10 when rotating in the direction of the arrow according to FIG. 5, a counter-torque on the lever arm 56, which tries to swivel the lever arm 56 clockwise around the bearing axle 24, so that the rod 56 arranged at the very bottom, as seen in FIG. 5, moves to the left out of its position (illustrated there) and thus set into motion the following lever linkage in such a manner that the mangle roller 10 is moved again in the direction of the outlet side of the laundry mangle. The compensation for the frictional force extends over the entire working width of the mangle.

FIG. 7 shows an arrangement corresponding to FIGS. 5 and 6. Of course, in this solution the mangle roller 10 is held stationarily with its bearing axle 24; and the trough 20 is held moveably by way of a floating bearing in the form of rollers 46. The idle bearing of the motor 48 and gear 50 within the second lever arm 56 leads in the case of the drive direction of the mangle roller 10 shown in FIG. 1 to a clockwise torque of the second lever arm 56. At the same time the trough 20 is moved to the left out of its position, shown there, over the rollers 46, as seen in FIG. 7, by means of the lever linkages, comprising of the members 58, 60, 62, 64 and 66, thus resulting in the ironing gap becoming narrower on the outlet side. In this solution, too, the result is a dynamic adaptation as a function of the respective frictional forces that occur.

In all of the previous embodiments either the mangle roller 10 or the trough 20 has been moved. Through a suitable combination of the embodiments, however, solutions wherein both the mangle roller 10 and the ironing trough 20 can be moved simultaneously are also possible.

It is still in the scope of the invention to employ sensor elements, as disclosed in accordance with the PCT/WO 85/03313, for the purpose of measuring the compressive load per unit area within the ironing gap between the mangle roller 10 and the ironing trough 20. The values determined thus could than be fed by way of a controller to the final control element (not illustrated), which then moves the mangle roller 10 and/or the ironing trough 20 relative to each other depending on the situation, in order to produce a uniform compressive load per unit area. Such final control elements can be formed by working cylinders whose end side engages with the bearing axle 24 in order to adjust the roller 10.

The power input caused by the driving torque of the roller can also be measured as the function of the frictional value and thus drive the power-generating device in the form of the respective adjusting means compensating for the friction. Within the scope of the invention it is also possible to select the compensating force in such a manner that not only the frictional force is compensated for, but also the laundry entry gap on the inlet side is somewhat larger than the exit gap on the outlet side, in order to facilitate the feed on the laundry articles into the mangle.

FIG. 8 shows the socalled exhaust air side of the laundry mangle according to the invention. It also represents the rear side of the mangle roller 10; and an exhaust air opening 66 placed in the center of the bearing 14 is connected in a known manner and, therefore, not illustrated in detail to a distributor network of a steam exhaust system. Since the working cylinder 16 disposed there does not have to absorb the gear-sided driving torque on the exhaust side of the laundry mangle, but rather this driving torque alone can occur, according to FIG. 1, by way of the working cylinder 16, the working cylinder 16 has only, according to FIG. 8, to engage with a shorter lever arm of the pair of lever arms 12, resulting, nevertheless, in a uniform ironing pressure, as shown in particular in FIG. 8. The working cylinder 16 according to FIG. 8 could also engage, as shown in FIG. 1, with a longer lever arm, but would not have to generate then all of the force and could be dimensioned smaller. To obtain a uniform ironing pressure or to increase the ironing pressure in the direction of the outlet side, it is expedient to provide at each arm of the pair of lever arms 12 a working cylinder 16 for support. However, it would also be conceivable to support the roller 10 only by way of one working cylinder (not illustrated) centered, for example, in its longitudinal direction. For a better overview, the force triangle for the working cylinder 16 shown there is also denoted with vector arrows in FIG. 8. To compensate for the frictional force, the working cylinders 16 can also function with a calculated, specified force, thus resulting in a kind of static arrangement. However, a dynamic compensation would also be conceivable where, for example, the respective cylinder 16 is driven so as to compensate continuously by way of a computer by means of suitable sensors in the ironing gap.

I claim:

1. Laundry mangle for counteracting a frictional force generated during service of the laundry mangle, said mangle comprising at least one mangle roller, at least one arm for supporting said mangle roller in a heatable trough in a service position, said mangle roller and said trough being movably positioned relative to each other, inlet and outlet passages for laundry articles provided between said mangle roller and heatable trough: a force generating mechanism which counteracts the frictional force generated during service of the laundry mangle comprising an adjusting device acting on a component selected from the group of components consisting of said mangle roller and said trough, wherein said adjusting device engages said supporting arm, and said supporting arm is swivelable about a point and movable with a movement selected from the group of movements consisting of translation and rotational movement in the service position: and wherein said trough is longitudinally movable and wherein said adjusting device acts directly on said trough.

2. Laundry mangle, as claimed in claim 1, wherein said adjusting device is selected from the group of devices consisting of a working cylinder, a spring, and a torque generating device.

3. Laundry mangle for counteracting a frictional force generated during service of the laundry mangle, said mangle comprising at least one mangle roller, at least one arm for supporting said mangle roller in a heatable trough in a service position, said mangle roller and said trough being movably positioned relative to each other, inlet and outlet passages for laundry articles provided between said mangle roller and heatable trough: a force generating mechanism which counteracts the frictional force generated during service of the laundry mangle comprising an adjusting device acting on a component selected from the group of components consisting of said mangle roller and said trough:

wherein said adjusting device engages said supporting arm, and said supporting arm is swivelable about a point and movable with a movement selected from the group of movements consisting of translation and rotational movement in the service position: and wherein said adjusting device produces, relative to a driving torque of said mangle roller, a counter-torque which acts on a component selected from the group of components consisting of said mangle roller and said trough.

4. Laundry mangle, as claimed in claim 3, wherein said adjusting device is selected from the group of devices consisting of a working cylinder, a spring, and a torque generating device.

5. Laundry mangle, as claimed in claim 3, wherein the force to be generated by said adjusting device is controlled by a setter.

6. Laundry mangle, as claimed in claim 3, further including stops to limit mobility of said mangle roller relative to the trough when said roller is in a position elevated relative to the trough.

7. Laundry mangle, as claimed in claim 3, including two working cylinders, one of which absorbs driving torque on a gear side.

8. Laundry mangle for counteracting a frictional force generated during service of the laundry mangle, said mangle comprising at least one mangle roller, at least one arm for supporting said mangle roller in a heatable trough in a service position, said mangle roller and said trough being movably positioned relative to each other, inlet and outlet passages for laundry articles provided between said mangle roller and heatable trough; a force generating mechanism which counteracts the frictional force generated during service of the laundry mangle comprising an adjusting device acting on a component selected from the group of components consisting of said mangle roller and said trough, said adjusting device comprising a torque generating device including a rotatable rocking arm, said mangle roller having an axle operatively connected to said rocking arm for rotating said roller.

* * * * *